US011745044B2

(12) United States Patent
Zhou

(10) Patent No.: US 11,745,044 B2
(45) Date of Patent: Sep. 5, 2023

(54) DUMBBELL FACILITATING WEIGHT ADJUSTMENT

(71) Applicant: Yongkang Yuanye Industrial Product Design Co., LTD, Jinhua (CN)

(72) Inventor: Dongqiang Zhou, Jinhua (CN)

(73) Assignee: YONGKANG YUANYE INDUSTRIAL PRODUCT DESIGN CO., LTD, Jinhua (CN)

( * ) Notice: Subject to any disclaimer, the term of this patent is extended or adjusted under 35 U.S.C. 154(b) by 127 days.

(21) Appl. No.: 17/399,029

(22) Filed: Aug. 10, 2021

(65) Prior Publication Data

US 2023/0046695 A1 Feb. 16, 2023

(51) Int. Cl.
*A63B 21/075* (2006.01)
*A63B 21/072* (2006.01)
*A63B 71/00* (2006.01)

(52) U.S. Cl.
CPC ..... *A63B 21/075* (2013.01); *A63B 21/0726* (2013.01); *A63B 21/0728* (2013.01); *A63B 71/0036* (2013.01)

(58) Field of Classification Search
CPC ..... A63B 21/0726; A63B 21/0728; A63B 71/0036; A63B 21/072–075
See application file for complete search history.

(56) References Cited

U.S. PATENT DOCUMENTS

2004/0005968 A1* 1/2004 Crawford ..... A63B 21/0607 482/106
2007/0225132 A1* 9/2007 Liu ..... A63B 21/0783 482/106
2009/0042700 A1* 2/2009 Liu ..... A63B 21/075 482/107
2015/0360073 A1* 12/2015 Moran ..... A63B 21/075 482/107
2015/0367163 A1* 12/2015 Moran ..... A63B 71/0036 482/108
2016/0166873 A1* 6/2016 Liu ..... A63B 21/0726 482/107
2017/0001061 A1* 1/2017 Marjama ..... A63B 71/0036
2017/0239510 A1* 8/2017 Wang ..... A63B 21/0724
2022/0176186 A1* 6/2022 Chen ..... A63B 21/075
2022/0347512 A1* 11/2022 Hong ..... A63B 21/0726

* cited by examiner

*Primary Examiner* — Joshua Lee
*Assistant Examiner* — Catrina A Letterman
(74) *Attorney, Agent, or Firm* — Daniel M. Cohn; Howard M. Cohn

(57) ABSTRACT

A dumbbell facilitating weight adjustment is disclosed. The dumbbell includes a dumbbell rod assembly, multiple counterweight disks, and a base for placing the dumbbell rod assembly and the multiple counterweight disks. The dumbbell rod assembly includes a mandrel, fixed disks and gear rotating disks fixed on the left and right sides of the mandrel, positioning rings and multiple coupling flanges. Rotation interference devices for preventing a rotation of the mandrel are provided in the fixed disks. Unlocking devices for unlocking the rotation interference devices are provided on the base. The rotation interference devices include push rods arranged on front sides and rear sides of the positioning rings, pressing rods arranged on upper parts of the push rods and return springs arranged on upper parts of the pressing rods. The unlocking devices include push pillars arranged on the base and cooperating with the push rods.

7 Claims, 13 Drawing Sheets

DUMBBELL FACILITATING WEIGHT ADJUSTMENT

CROSS REFERENCE TO RELATED APPLICATION

This patent application claims the benefit and priority of Chinese Patent Application No. 202020963826.9 filed on May 29, 2020, the disclosure of which is incorporated by reference herein in its entirety as part of the present application.

TECHNICAL FIELD

The present disclosure relates to a dumbbell, and more specifically, to a dumbbell facilitating weight adjustment.

BACKGROUND ART

The existing dumbbells are divided into various models according to their weights, and their weights are not adjustable. With the increase of practice time, users must purchase multiple sets of dumbbells with different weights in order to meet the needs of strength enhancement, which undoubtedly increases the cost. Although there are dumbbells with adjustable weight, its structure is that multiple dumbbell pieces are configured at both ends of the dumbbell rod and fixed by bolts and nuts. The user can disassemble the dumbbell piece as required, which is troublesome and needs the help of tools such as wrench, and it is not convenient to use. Not only the adjustable gears are few, but also the left and right sides are adjusted respectively, and the two sides are easy to interfere with each other.

SUMMARY

The technical problem to be solved by the disclosure is to provide a dumbbell facilitating weight adjustment. The provided dumbbell can be adjusted at the same time on the left and right sides or on one side, which facilitates weight adjustment and can realize more adjustable gears.

The disclosure provides a dumbbell facilitating weight adjustment, including a dumbbell rod assembly, multiple counterweight disks, and a base for placing the dumbbell rod assembly and the multiple counterweight disks. The dumbbell rod assembly includes a mandrel, fixed disks and gear rotating disks fixed on the left and right sides of the mandrel, positioning rings and multiple coupling flanges. The gear rotating disks are fixed on ends of the mandrel. The gear rotating disks drive the positioning rings and the multiple coupling flanges to rotate simultaneously by rotating the mandrel. At least one flange protrusion is respectively arranged on a side of each of the coupling flanges. At least one counterweight protrusion is respectively arranged on a side of each of the counterweight disks. The counterweight protrusions of the counterweight disks cooperate with the corresponding flange protrusions of the coupling flanges. Rotation interference devices for preventing a rotation of the mandrel are provided in the fixed disks. Unlocking devices for unlocking the rotation interference devices are provided on the base. The rotation interference devices include push rods arranged on front sides and rear sides of the positioning rings, pressing rods arranged on upper parts of the push rods and return springs arranged on upper parts of the pressing rods. The unlocking devices include push pillars arranged on the base and cooperating with the push rods. Limiting pillars are arranged on lower parts of the pressing rods. Multiple gear holes are arranged on outer ring surfaces of the positioning rings. And under actions of the return springs, the lower limiting pillars are clamped into the gear holes to limit the rotation of the mandrel.

The disclosure further provides a dumbbell facilitating weight adjustment, including a dumbbell rod assembly, multiple counterweight disks, and a base for placing the dumbbell rod assembly and the multiple counterweight disks. The dumbbell rod assembly includes a mandrel, fixed disks fixed on the left and right sides of the mandrel, a gear rotating disk fixed on the left side or the right side of the mandrel, positioning rings and multiple coupling flanges. The gear rotating disks are fixed on ends of the mandrel. The gear rotating disks drive the positioning rings and the multiple coupling flanges to rotate simultaneously by rotating the mandrel. At least one flange protrusion is respectively arranged on a side of each of the coupling flanges. At least one counterweight protrusion is respectively arranged on a side of each of the counterweight disks. The counterweight protrusions of the counterweight disks cooperate with the corresponding flange protrusions of the coupling flanges. Rotation interference devices for preventing a rotation of the mandrel are provided in the fixed disks. Unlocking devices for unlocking the rotation interference devices are provided on the base. The rotation interference devices include push rods arranged on front sides and rear sides of the positioning rings, pressing rods arranged on upper parts of the push rods and return springs arranged on upper parts of the pressing rods. The unlocking devices include push pillars arranged on the base and cooperating with the push rods. Limiting pillars are arranged on lower parts of the pressing rods. Multiple gear holes are arranged on outer ring surfaces of the positioning rings. And under actions of the return springs, the lower limiting pillars are clamped into the gear holes to limit the rotation of the mandrel.

Further, connecting plates, fixed sheets and connecting sheets are further arranged on the left and right sides of the mandrel. The connecting plates are fixed on the fixed disks. Two ends of the connecting plate are respectively fixed on the fixed disk and the fixed sheet. A U-shaped groove is respectively arranged on each of counterweight disks, and the connecting sheets are placed in the U-shaped grooves.

Further, rotating parts are respectively arranged in the fixed sheets and the fixed plates. The rotating parts are sheathed on the mandrel. And the mandrel and the rotating parts rotate with each other.

Further, gear balls are arranged on outer sides of the fixed sheets, and multiple gear holes matched with the gear balls are correspondingly arranged on inner walls of the gear rotating disks.

Further, a handle is fixedly arranged in a middle of the mandrel, and the handle is integrally connected with the connecting plates on both sides of the handle.

Further, placement grooves for placing the counterweight disks and multiple isolation plates for separating the counterweight disks are arranged on the base, and positioning grooves for accommodating the corresponding counterweight protrusions are arranged on each of the isolation plates.

Further, five counterweight plates and corresponding five coupling flanges are respectively arranged on the left and right sides of the mandrel.

Compared with the prior art, the dumbbell facilitating weight adjustment includes a dumbbell rod assembly, multiple counterweight disks, and a base for placing the dumbbell rod assembly and the multiple counterweight disks. The dumbbell rod assembly includes a mandrel, fixed disks and gear rotating disks fixed on the left and right sides of the mandrel, positioning rings and multiple coupling flanges. The rotation interference devices for preventing a rotation of the mandrel are provided in the fixed disks. The unlocking devices for unlocking the rotation interference devices are provided on the base. The rotation interference devices include push rods arranged on front sides and rear sides of the positioning rings, pressing rods arranged on upper parts of the push rods and return springs arranged on upper parts of the pressing rods. The unlocking devices include push pillars arranged on the base and cooperating with the push rods. The limiting pillars are arranged on lower parts of the pressing rods. The multiple gear holes are evenly distributed on the outer ring surfaces of the positioning rings. Under the actions of the return springs, the limiting pillars are clamped into the gear holes to limit the rotation of the mandrel. The mandrel can rotate only when the unlocking devices unlock the rotation interference devices. In the disclosure, the gear rotating disks drive the mandrel to rotate, which realizes multi gear adjustment of the weight of the desired counterweight disks, and the adjustment is convenient.

DETAILED DESCRIPTION OF THE EMBODIMENTS

In order to make the technical problems, technical solutions and beneficial effects to be solved by the disclosure clearer, the disclosure is further described in detail below in combination with the accompanying drawings and embodiments. It should be understood that the specific embodiments described herein are only used to explain the disclosure and are not used to limit the disclosure.

Embodiment 1

Figure 1:
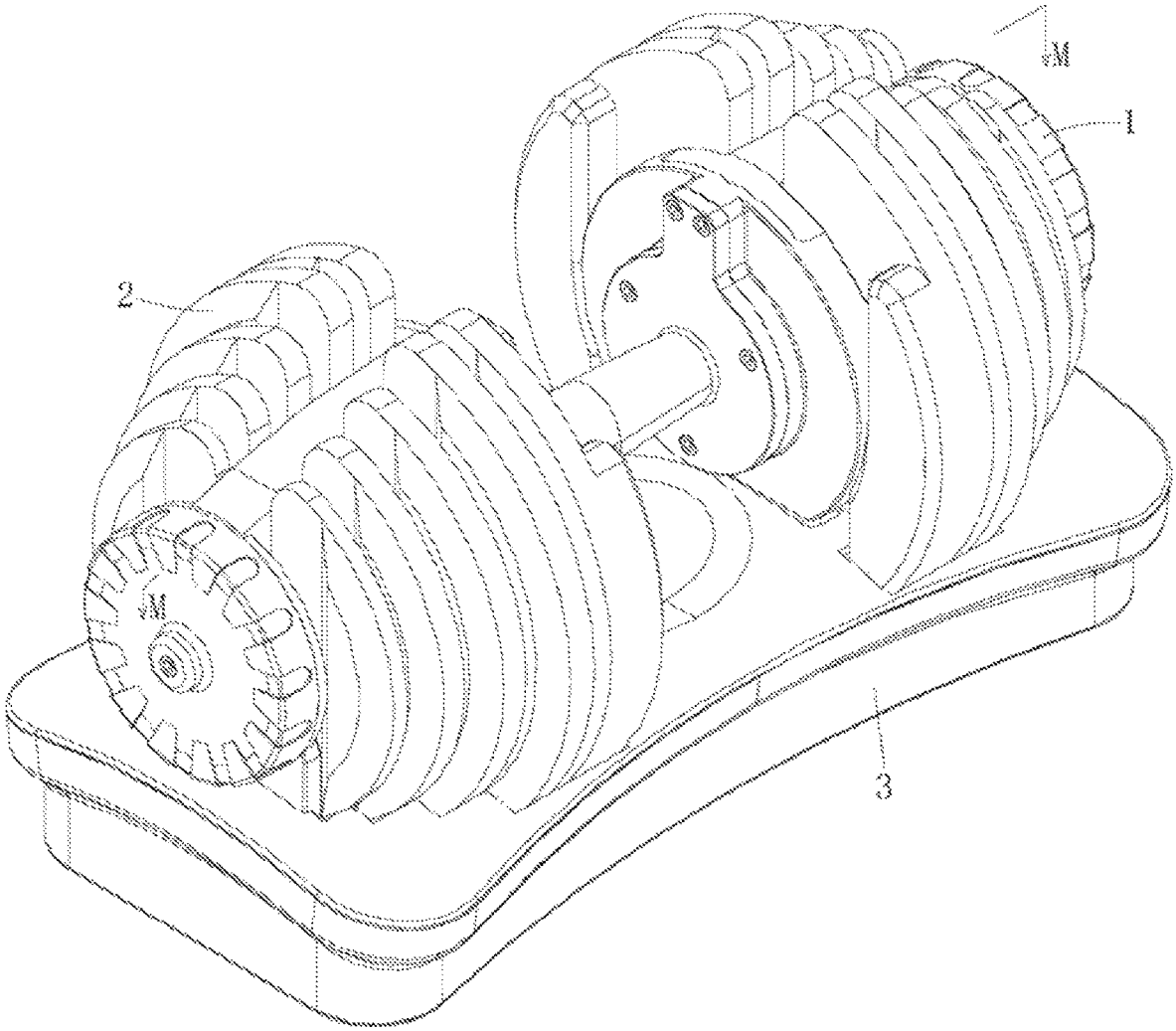
FIG. 1 is a three-dimensional schematic diagram of a preferred embodiment of the present disclosure.
Figure 2:
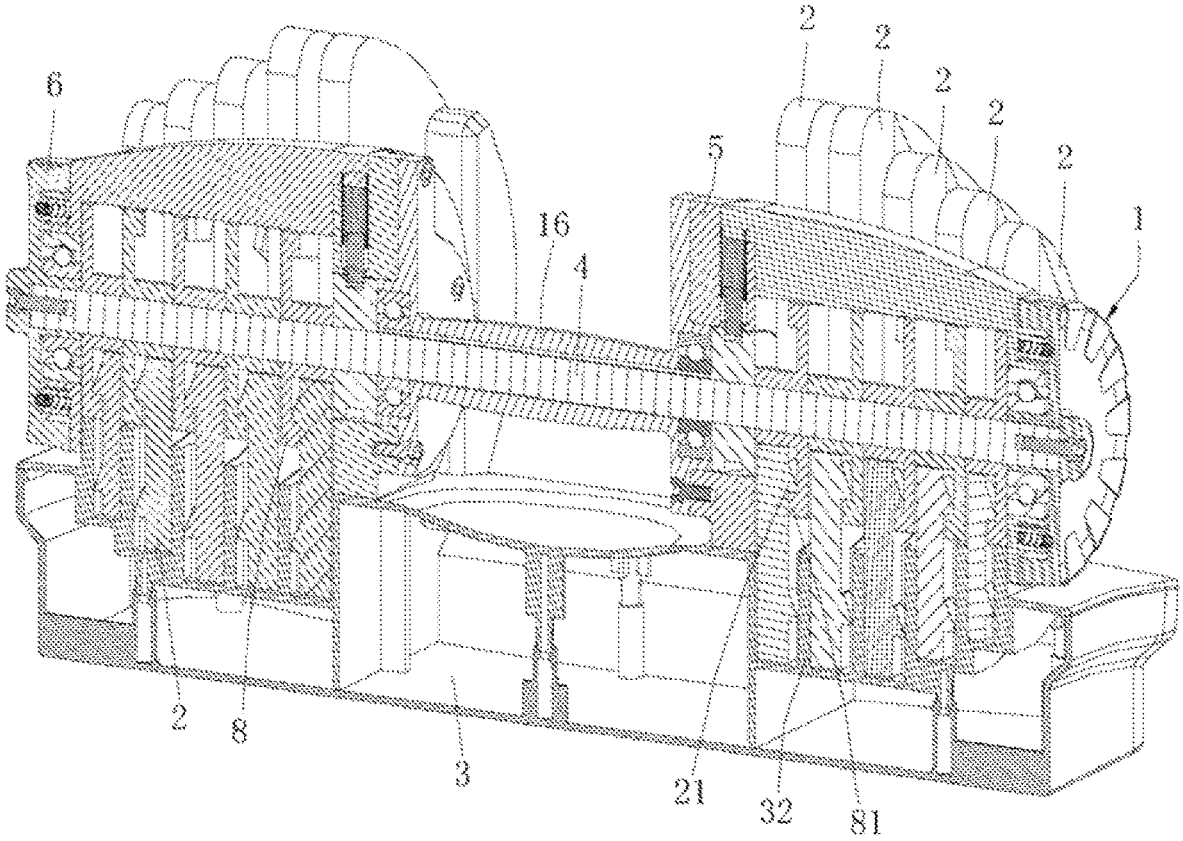
FIG. 2 is the schematic diagram of M-M section in FIG. 1.
Figure 5:
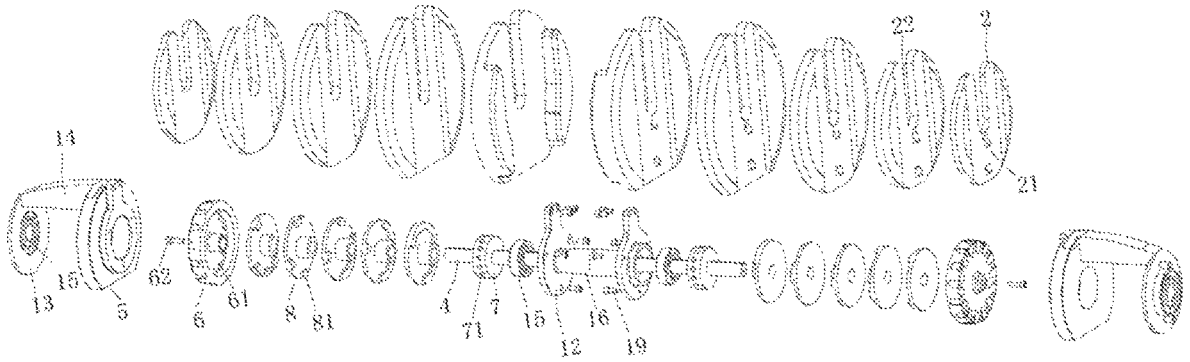
FIG. 5 is the exploded view of FIG. 4.

Referring to FIG. 1, FIG. 2 and FIG. 5, a preferred embodiment of the dumbbell facilitating weight adjustment of the disclosure includes a dumbbell rod assembly 1, multiple counterweight disks 2 and a base 3 for placing the dumbbell rod assembly 1 and the multiple counterweight disks 2. The dumbbell rod assembly 1 includes a mandrel 4, fixed disks 5 and gear rotating disks 6 symmetrically fixed on the left and right sides of the mandrel 4, positioning rings 7 and multiple coupling flanges 8. Because multiple components of the dumbbell rod assembly 1 and multiple counterweight disks 2 are symmetrically arranged left and right relative to the mandrel 4, only the components on one side are marked in the figure, and the same components on the other side are omitted.

Figure 3:
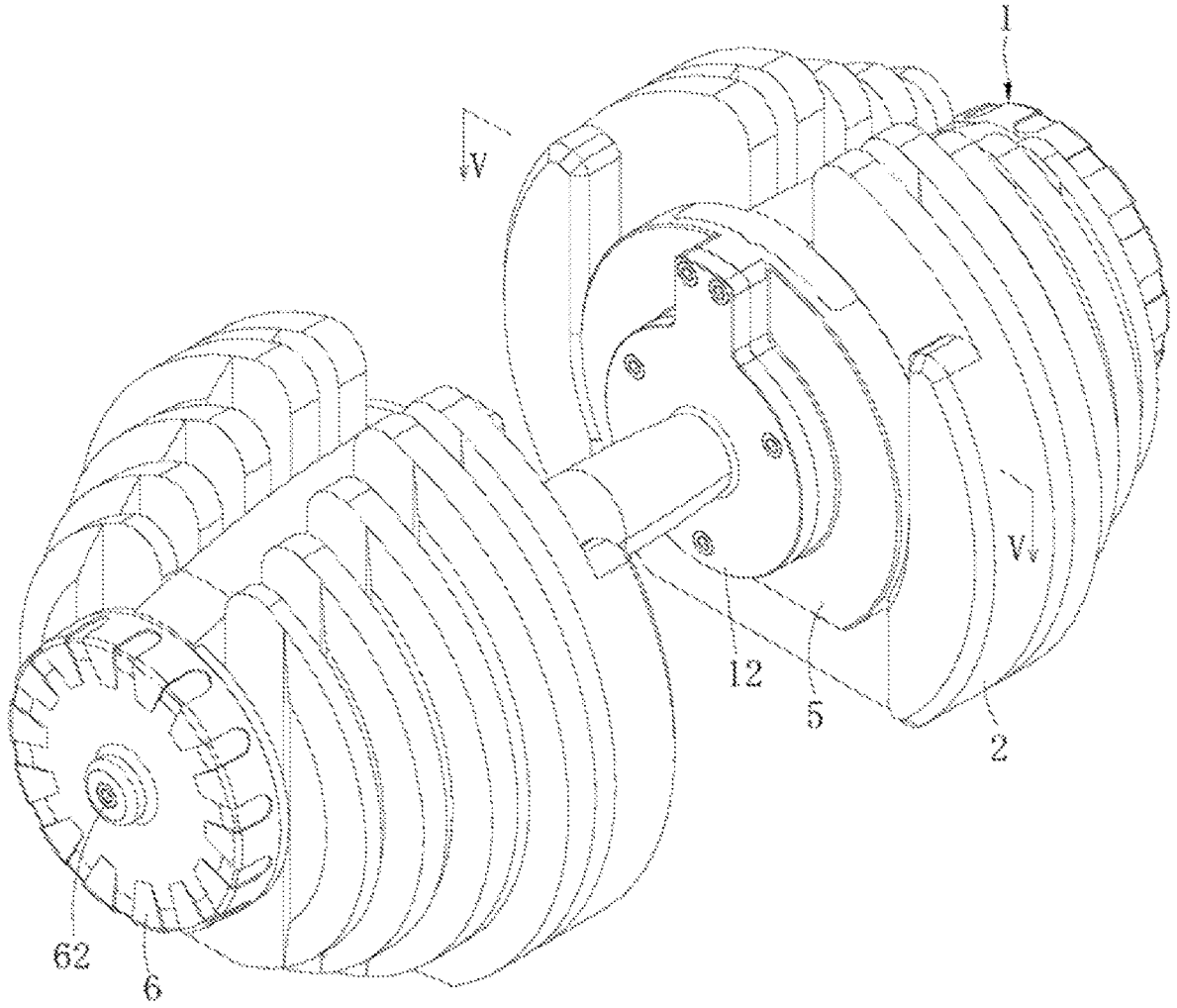
FIG. 3 is the three-dimensional schematic diagram of the dumbbell rod assembly equipped with all counterweight disks in FIG. 1.
Figure 6:
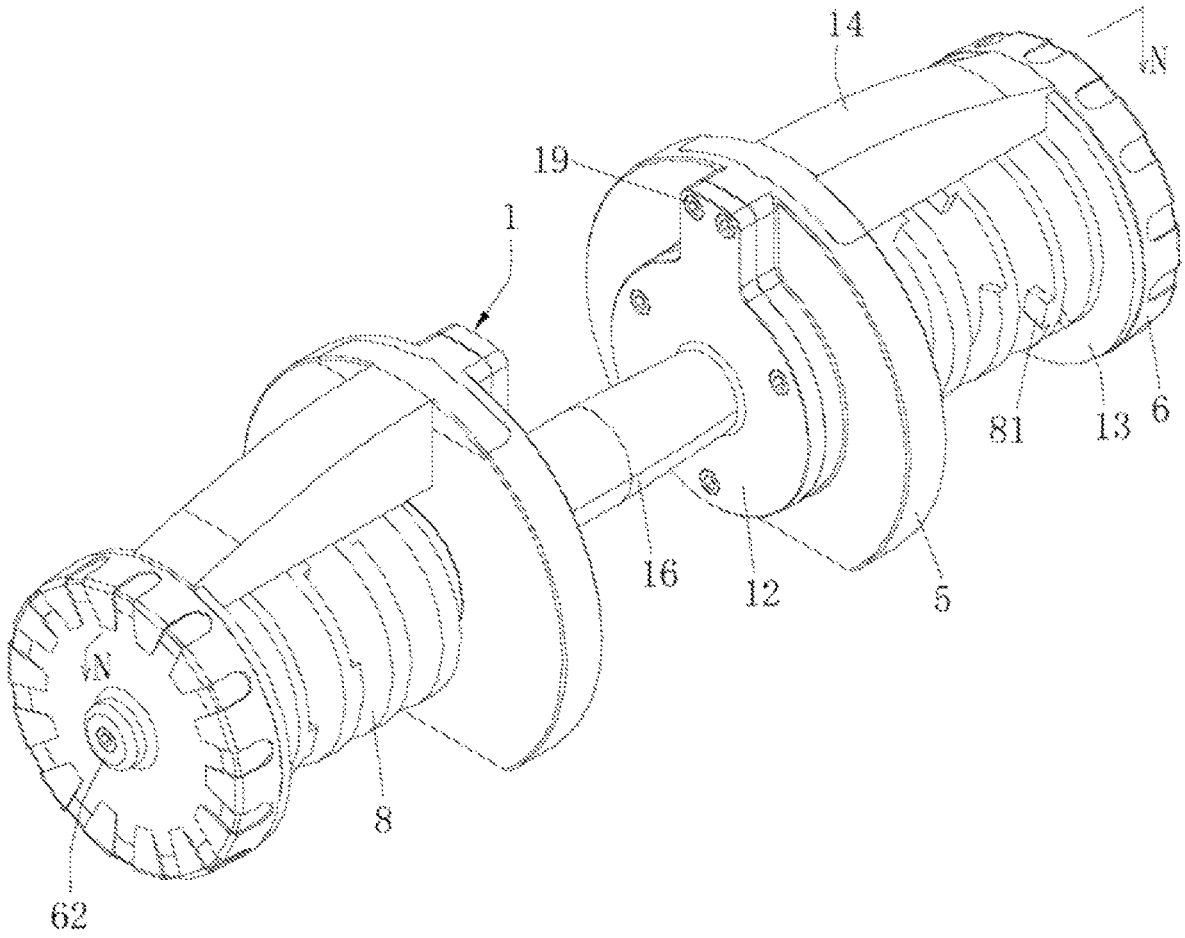
FIG. 6 is the three-dimensional schematic diagram of the dumbbell rod assembly in FIG. 3.
Figure 7:
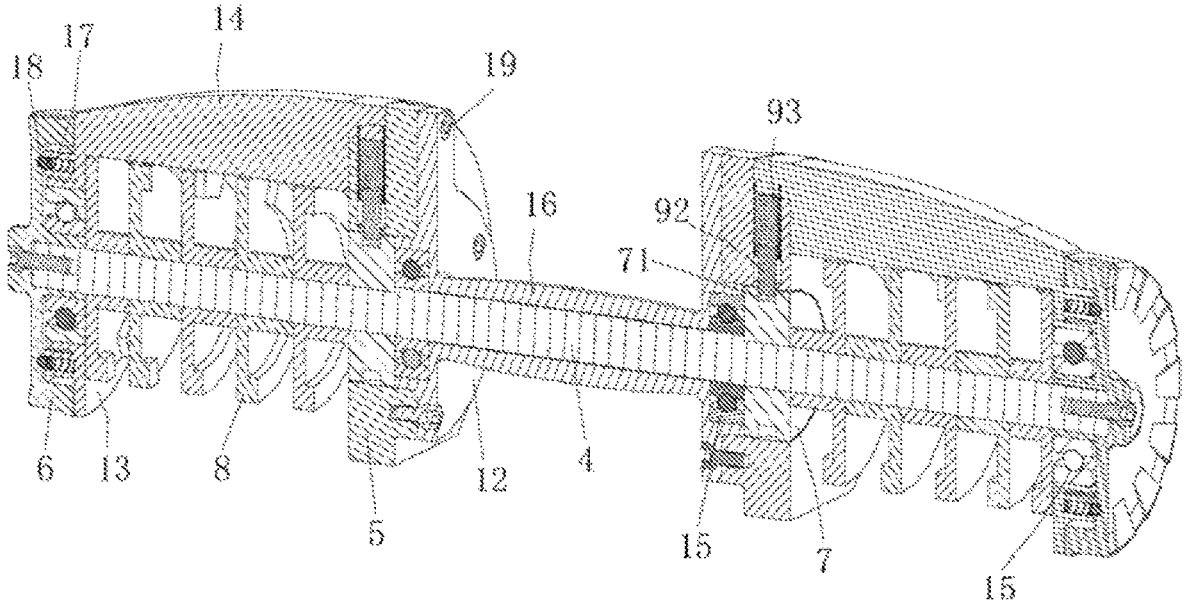
FIG. 7 is the schematic diagram of N-N section in FIG. 6.

As shown in FIG. 2, FIG. 3, FIG. 6 and FIG. 7, the gear rotating disks 6 are fixed at the ends of the mandrel 4 by bolts 62. The gear rotating disks 6 drive the positioning rings 7 and multiple coupling flanges 8 to rotate simultaneously by rotating the mandrel 4. At least one flange protrusion 81 is respectively arranged on the side of each of the coupling flanges 8, and at least one counterweight protrusion 21 is respectively arranged on the side of each of the counterweight disks 2. The counterweight protrusions 21 of the counterweight disks 2 cooperate with the flange protrusions 81 of the corresponding coupling flanges 8. When the gear rotating disks 6 rotate the mandrel 4, the flange protrusions 81 hook or release the counterweight protrusions 21, so that the desired counterweight disks 2 are hooked onto or loosened from the mandrel 4, and the weight adjustment of the desired counterweight disks is realized. It is simple and convenient to adjust the gear of counterweight disks 2. When the counterweight protrusions 21 of all counterweight disks 2 are hooked by the flange protrusions 81 of the coupling flanges 8, the dumbbell weight is the heaviest, as shown in FIG. 3. Conversely, when the counterweight protrusions 21 of all counterweight disks 2 is decoupled from the flange protrusions 81 of the connected flanges 8, the dumbbell weight is the lightest, as shown in FIG. 6.

As shown in FIG. 3, FIG. 8, FIG. 12 and FIG. 13, rotation interference devices 9 for preventing a rotation of the mandrel 4 are provided in the fixed disks 5, and unlocking devices 10 for unlocking the rotation interference devices 9 are provided on the base 3. The rotation interference devices 9 include push rods 91 arranged on the front and rear sides of the positioning rings 7, pressing rods 92 arranged on the upper parts of the push rods 91, and return springs 93 arranged on the upper parts of the pressing rods 92. The unlocking devices 10 include push pillars 11 arranged on the base 3 and cooperating with the push rods 91. The limiting columns 94 are arranged on the lower parts of the pressing rods 92, and multiple gear holes 71 are evenly distributed on the outer ring surfaces of the positioning rings 7. Under the actions of the return springs 93, the lower limiting pillars 94 are clamped into the gear holes 71 to limit the rotation of the mandrel 4. The mandrel 4 can rotate only when the unlocking devices 10 unlock the rotation interference devices 9. The purpose of setting the two push rods 91 is to make the lifting movement of the pressing rods 92 more stable.

Figure 13:
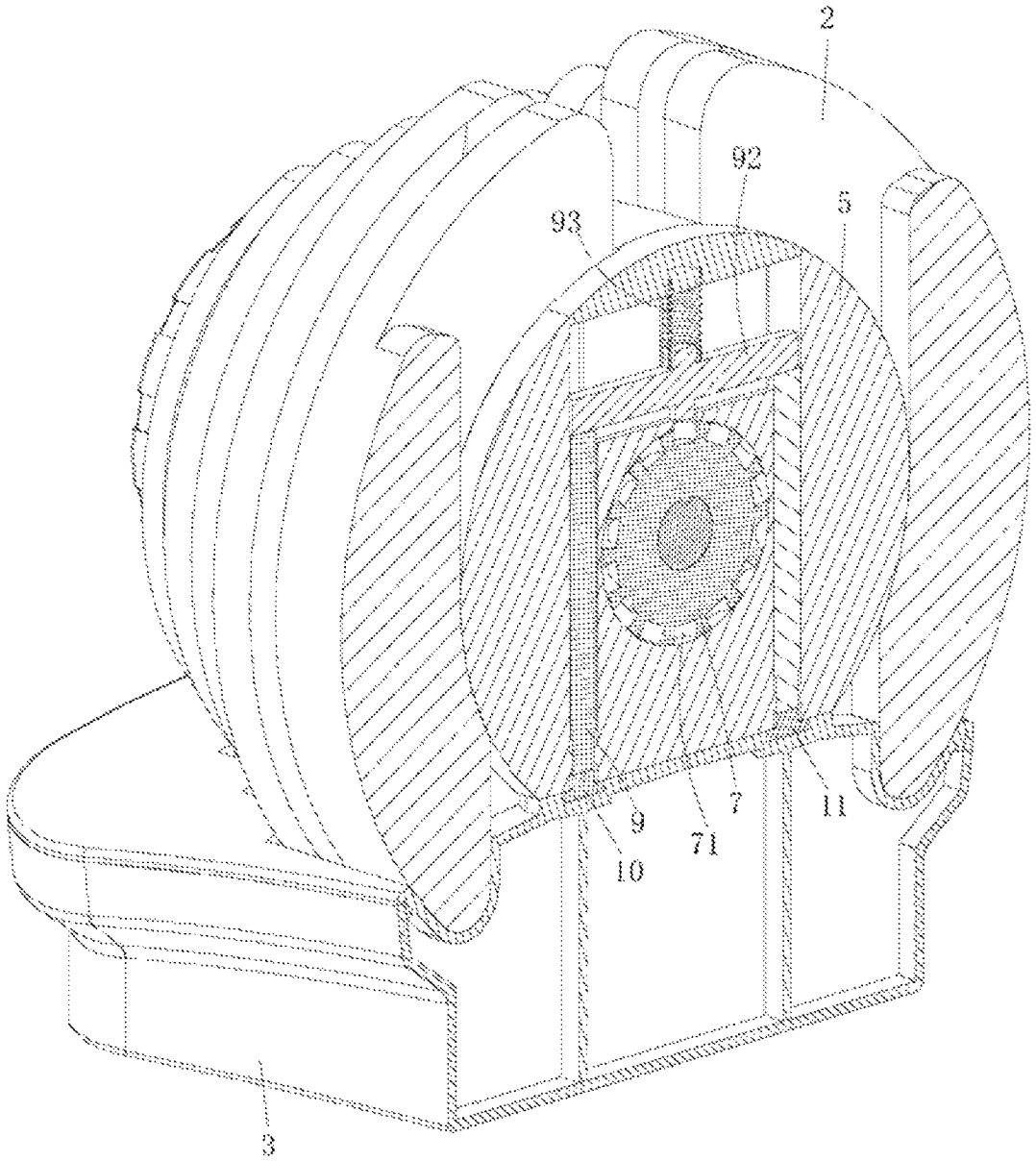
FIG. 13 is the schematic diagram of V-V section in FIG. 3.

As shown in FIG. 13, when the dumbbell rod assembly 1 is placed on the base 3, the push rods 91 of the rotation interference devices 9 are just pressed against the push pillars 11 of the unlocking devices 10. The push rods 91 are jacked up and drive the pressing rods 92 to move upward. The limiting pillars 94 of the pressing rods 92 are disengaged from the gear holes 71 of the positioning rings 7, and the rotation interference devices 9 are unlocked. The rotation interference devices 9 no longer limit the position of the positioning rings 7, and the gear rotating disks 6 can drive the mandrel 4 to rotate.

As shown in FIG. 5, FIG. 6, FIG. 7, FIG. 8 and FIG. 9, connecting plates 12, fixed sheets 13 and connecting sheets 14 are further arranged on the left and right sides of the mandrel 4. The connecting plates 12 are fixed on the fixed disks 5 by bolts 19. Two ends of each connecting plate 14 is respectively fixed on the fixed disk 5 and the fixed sheet 13. A U-shaped groove 22 is respectively arranged on each of the counterweight disks 2, and the connecting sheets 14 are placed in the U-shaped grooves. Multiple coupling flanges 8 are arranged between the fixed disks 5 and the fixed sheets 13.

The rotating parts 15 are respectively arranged in the fixed sheets 13 and the fixed disks 5. The rotating parts 15 are sheathed on the mandrel 4. The mandrel 4 and the rotating parts 15 rotate with each other. The rotating parts 15 are arranged to facilitate the flexible rotation of the mandrel 4. The rotating parts 15 may be rotating bearings or sliding sleeves. In the present embodiment, the rotating parts 15 are the rotating bearings.

As shown in FIG. 5, FIG. 6, FIG. 7, FIG. 8, FIG. 9, FIG. 10 and FIG. 11, two gear balls 18 are arranged up and down on the outer side of the fixed sheet, and multiple gear holes 61 matched with the gear balls 18 are correspondingly arranged on inner walls of the gear rotating disk 6. The springs 17 are set behind the gear balls 18. The gear balls 18 are matched with the gear holes 61 to enhance the stability and hand feel when the gear rotating disks 6 rotate. Different gear marks are set on the surface of gear rotating disks 6 to facilitate the selection of the counterweight disks 2.

As shown in FIG. 5, FIG. 6, FIG. 7 and FIG. 8, a handle 16 is fixedly arranged in a middle of the mandrel 4, and the handle 16 is integrally connected with the connecting plates 12 on both sides of the handle 16.

Figure 8:
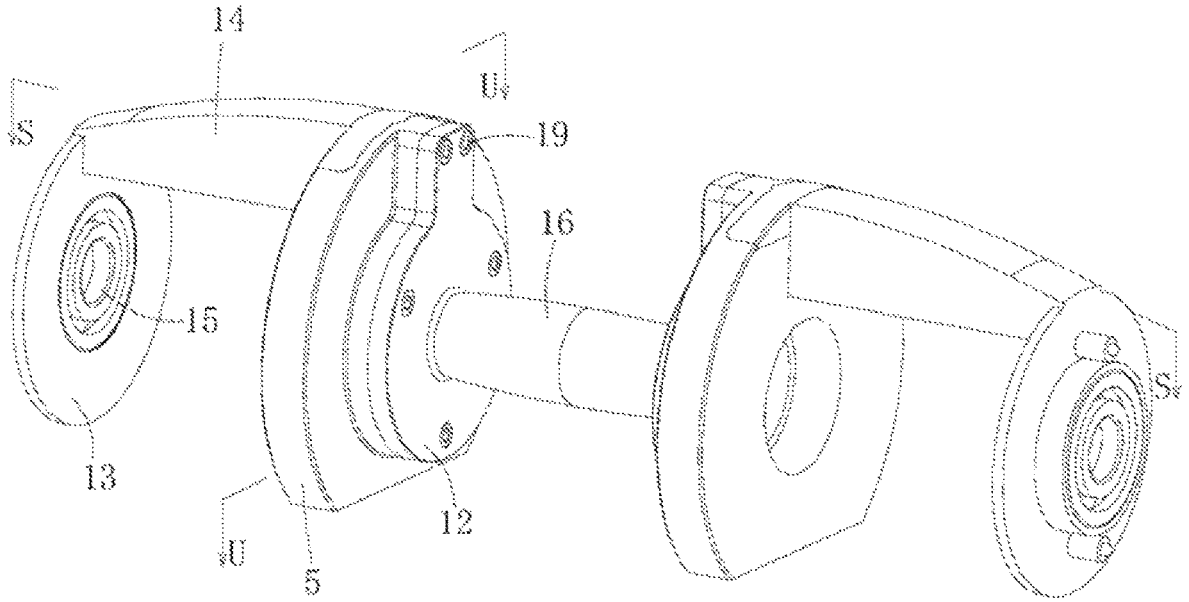
FIG. 8 is the three-dimensional schematic diagram of the fixed parts in FIG. 6.
Figure 9:
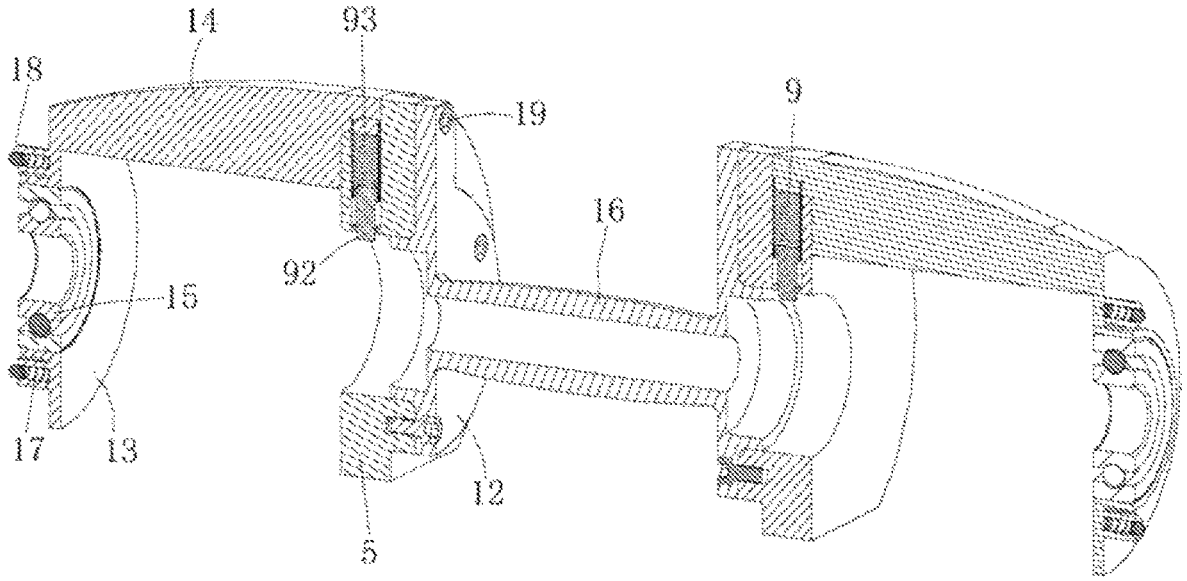
FIG. 9 is the schematic diagram of S-S section in FIG. 8.
Figure 10:
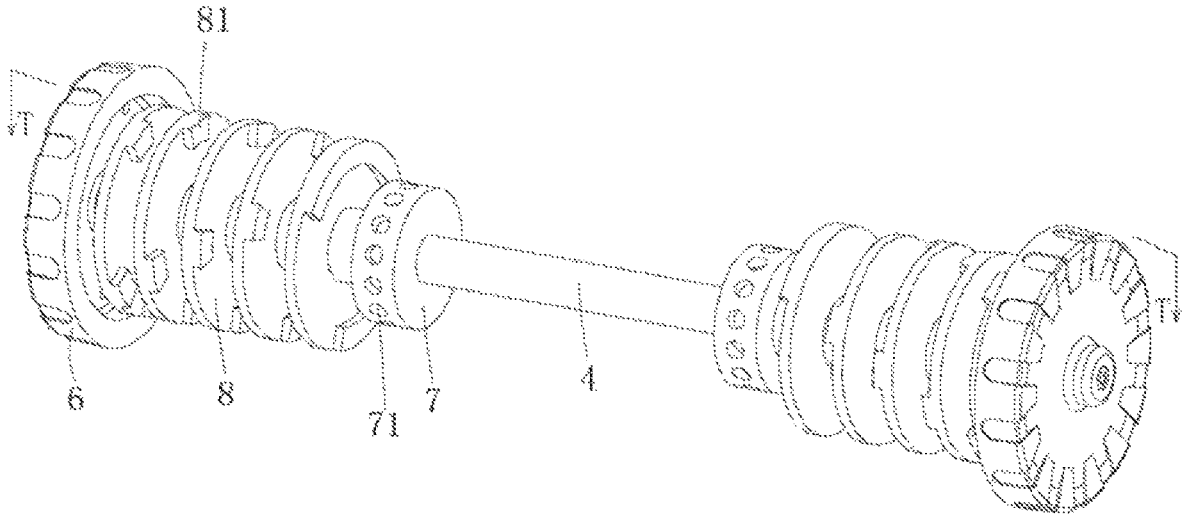
FIG. 10 is the three-dimensional schematic diagram of the rotating parts in FIG. 6.
Figure 11:
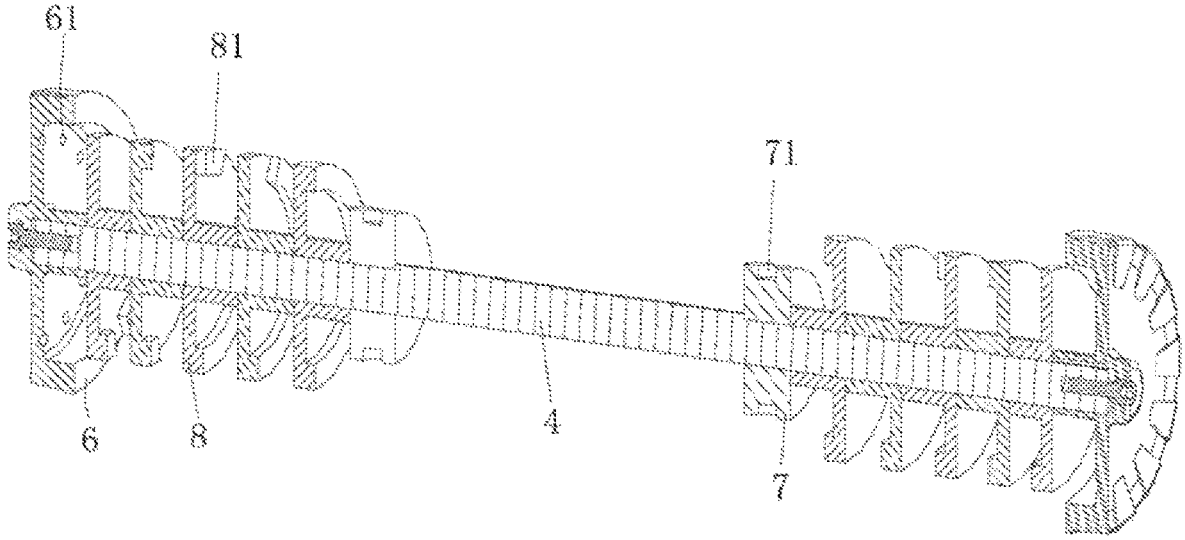
FIG. 11 is the schematic diagram of T-T section in FIG. 10.
Figure 12:
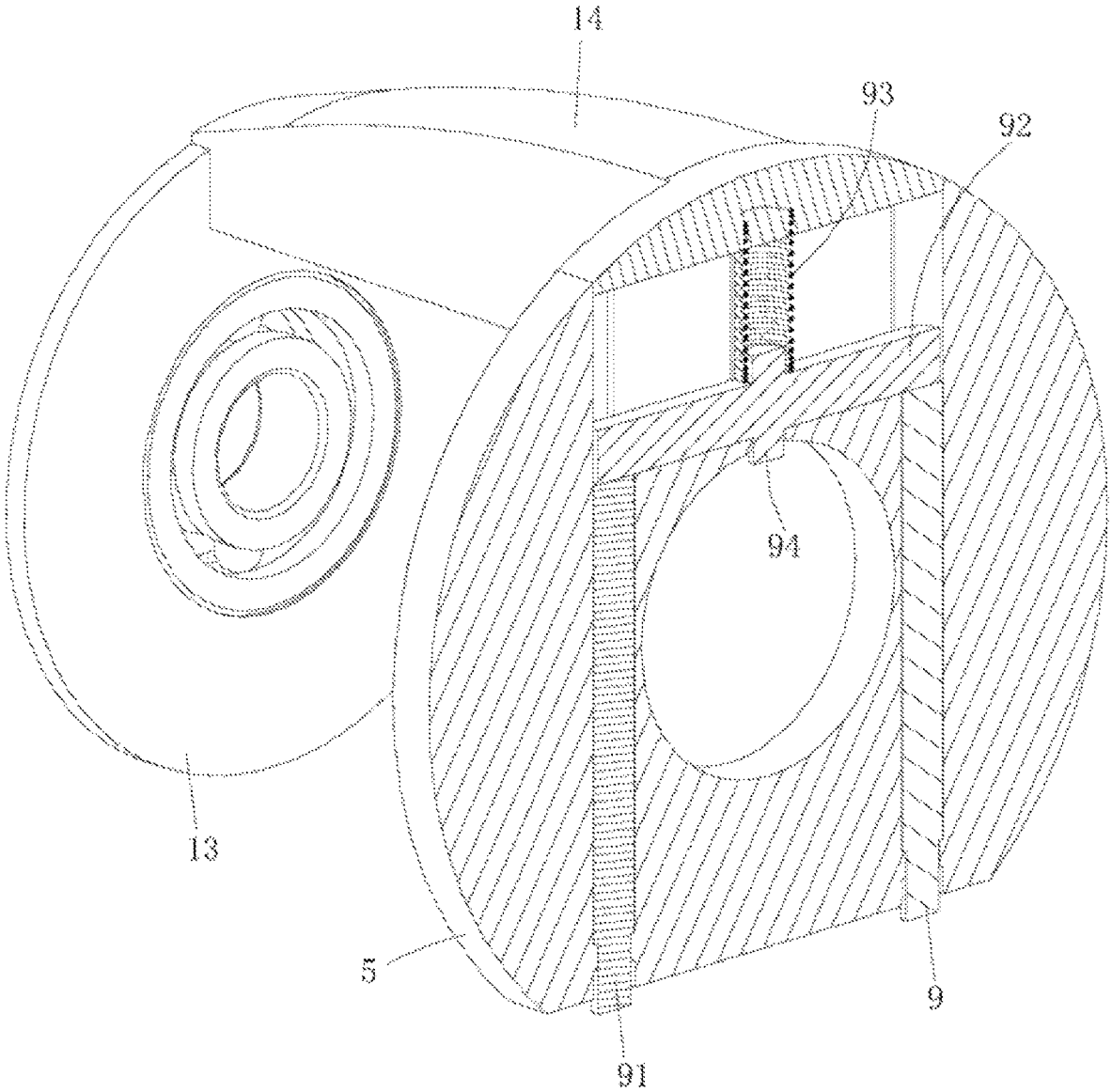
FIG. 12 is the schematic diagram of U-U section in FIG. 8.

As shown in FIG. 8, the components in the dumbbell rod assembly 1 that do not rotate with the mandrel 4 include the fixed disks 5, the connecting plates 12, the fixed sheets 13, the connecting sheets 14 and the handle 16. As shown in FIG. 10, the components in the dumbbell rod assembly 1 that rotate with the mandrel 4 include the gear rotating disks 6, the positioning rings 7 and the multiple coupling flanges 8.

Figure 4:
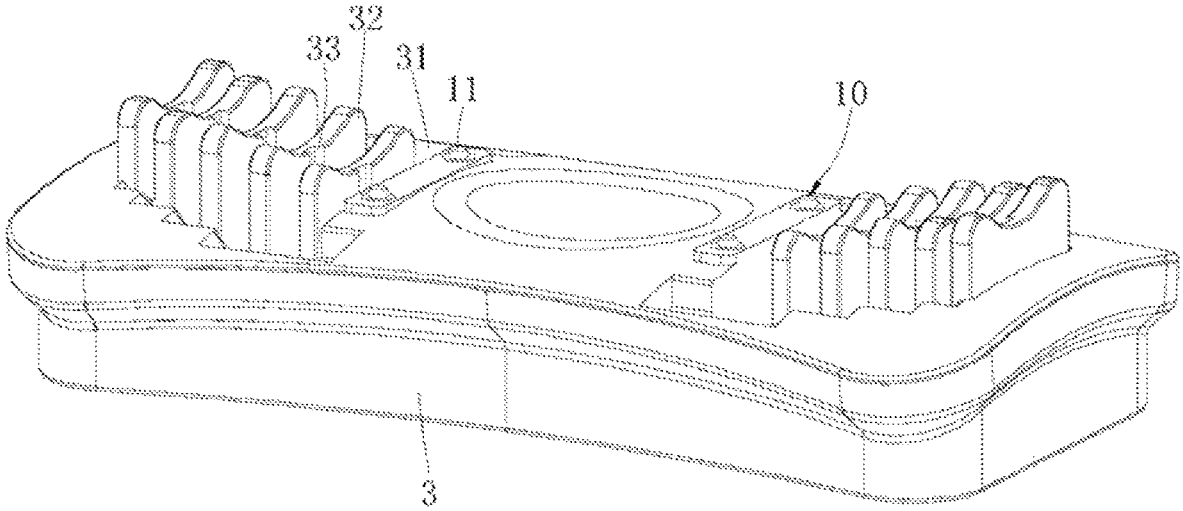
FIG. 4 is the three-dimensional schematic diagram of the base in FIG. 1.

As shown in FIG. 1, FIG. 2 and FIG. 4, placement grooves 31 for placing the counterweight disks 2 and multiple isolation plates 32 for separating the counterweight disks 2 are arranged on the base 3, and positioning grooves 33 for accommodating the corresponding counterweight protrusions 21 are arranged on each of the isolation plates 32.

As shown in FIG. 1, FIG. 2, FIG. 3 and FIG. 5, five counterweight disks 2 and corresponding five coupling flanges 8 are respectively arranged on the left and right sides of the mandrel 4. Correspondingly, five isolation plates 32 are arranged on the base 3. The counterweight disks 2 of the disclosure provide more gears to choose from.

Embodiment 2

The main difference between this embodiment and embodiment 1 is that the gear rotating disk 6 is separately arranged on the left or right side of the mandrel 4 (not marked in the figure). Rotating one gear rotating disk 6 can drive the mandrel 4 to rotate and realize the adjustment of the counterweight disks 2. Other structures and functions are the same as those in embodiment 1 and will not be described again.

The above is only preferred embodiments of the disclosure and is not intended to limit the disclosure. Any modification, equivalent replacement and improvement made within the spirit and principles of the disclosure shall be included in the protection scope of the disclosure.

What is claimed is:

1. A dumbbell facilitating weight adjustment, comprising a dumbbell rod assembly, a plurality of counterweight disks, and a base for placing the dumbbell rod assembly and the plurality of counterweight disks; wherein the dumbbell rod assembly comprises a mandrel, fixed disks and gear rotating disks fixed on the left and right sides of the mandrel, positioning rings and a plurality of coupling flanges; the gear rotating disks are fixed on ends of the mandrel; the gear rotating disks drive the positioning rings and the plurality of coupling flanges to rotate simultaneously by rotating the mandrel; at least one flange protrusion is respectively arranged on a side of each of the coupling flanges; at least one counterweight protrusion is respectively arranged on a side of each of the counterweight disks; the counterweight protrusions of the counterweight disks cooperate with the corresponding flange protrusions of the coupling flanges; rotation interference devices for preventing a rotation of the mandrel are provided in the fixed disks; unlocking devices for unlocking the rotation interference devices are provided on the base; the rotation interference devices comprise push rods arranged on front sides and rear sides of the positioning rings, pressing rods arranged on upper parts of the push rods and return springs arranged on upper parts of the pressing rods; the unlocking devices comprise push pillars arranged on the base and cooperating with the push rods; limiting pillars are arranged on lower parts of the pressing rods; a plurality of gear holes are evenly distributed on outer ring surfaces of the positioning rings; and under actions of the return springs, the lower limiting pillars are clamped into the gear holes to limit the rotation of the mandrel.

2. The dumbbell of claim 1, wherein connecting plates, fixed sheets and connecting sheets are further arranged on the left and right sides of the mandrel; the connecting plates are fixed on the fixed disks; two ends of the connecting sheet are respectively fixed on the fixed disk and the fixed sheet; a U-shaped groove is respectively arranged on each of counterweight disks, and the connecting sheets are placed in the U-shaped grooves.

3. The dumbbell of claim 2, wherein rotating parts are respectively arranged in the fixed sheets and the fixed plates; the rotating parts are sheathed on the mandrel; and the mandrel and the rotating parts rotate with each other.

4. The dumbbell of claim 2, wherein gear balls are arranged on outer sides of the fixed sheets, and a plurality of gear holes matched with the gear balls are correspondingly arranged on inner walls of the gear rotating disks.

5. The dumbbell of claim 2, wherein a handle is fixedly arranged in a middle of the mandrel, and the handle is integrally connected with the connecting plates on both sides of the handle.

6. The dumbbell of claim 1, wherein placement grooves for placing the counterweight disks and a plurality of isolation plates for separating the counterweight disks are arranged on the base, and positioning grooves for accommodating the corresponding counterweight protrusions are arranged on each of the isolation plates.

7. A dumbbell facilitating weight adjustment, comprising a dumbbell rod assembly, a plurality of counterweight disks, and a base for placing the dumbbell rod assembly and the plurality of counterweight disks; wherein the dumbbell rod assembly comprises a mandrel, fixed disks fixed on the left and right sides of the mandrel, a gear rotating disk fixed on the left side or the right side of the mandrel, positioning rings and a plurality of coupling flanges; the gear rotating disks are fixed on ends of the mandrel; the gear rotating disks drive the positioning rings and the plurality of coupling flanges to rotate simultaneously by rotating the mandrel; at least one flange protrusion is respectively arranged on a side of each of the coupling flanges; at least one counterweight protrusion is respectively arranged on a side of each of the counterweight disks; the counterweight protrusions of the counterweight disks cooperate with the corresponding flange protrusions of the coupling flanges; rotation interference devices for preventing a rotation of the mandrel are provided in the fixed disks; unlocking devices for unlocking the rotation interference devices are provided on the base; the rotation interference devices comprise push rods arranged on front sides and rear sides of the positioning rings, pressing rods arranged on upper parts of the push rods and return springs arranged on upper parts of the pressing rods; the unlocking devices comprise push pillars arranged on the base and cooperating with the push rods; limiting pillars are arranged on lower parts of the pressing rods; a plurality of gear holes are evenly distributed on outer ring surfaces of the positioning rings; and under actions of the return springs, the lower limiting pillars are clamped into the gear holes to limit the rotation of the mandrel.

* * * * *